US008193993B2

(12) United States Patent
Maddaleno

(10) Patent No.: US 8,193,993 B2
(45) Date of Patent: Jun. 5, 2012

(54) ANTENNA SUB-ASSEMBLY FOR ELECTRONIC DEVICE

(75) Inventor: Marco Maddaleno, Turin (IT)

(73) Assignee: Motorola Mobility, Inc., Libertyville, IL (US)

( * ) Notice: Subject to any disclaimer, the term of this patent is extended or adjusted under 35 U.S.C. 154(b) by 272 days.

(21) Appl. No.: 12/463,603

(22) Filed: May 11, 2009

(65) Prior Publication Data

US 2009/0224987 A1 Sep. 10, 2009

(51) Int. Cl.
*H01Q 1/24* (2006.01)

(52) U.S. Cl. ..... 343/702; 343/700 MS

(58) Field of Classification Search ..... 343/700 MS, 343/702
See application file for complete search history.

(56) References Cited

U.S. PATENT DOCUMENTS

| | | | | |
|---|---|---|---|---|
| 4,625,212 | A | 11/1986 | Oda et al. | |
| 4,862,181 | A | 8/1989 | Ponce De Leon et al. | |
| 4,955,084 | A | 9/1990 | Umetsu et al. | |
| 5,300,937 | A | 4/1994 | Capp et al. | |
| 5,808,584 | A | 9/1998 | Skahill | |
| 5,861,854 | A | 1/1999 | Kawahata et al. | |
| 5,940,041 | A | 8/1999 | Koyama et al. | |
| 6,177,908 | B1 | 1/2001 | Kawahata et al. | |
| 6,195,048 | B1 | 2/2001 | Chiba et al. | |
| 6,646,610 | B2 | 11/2003 | Troelsen | |
| 6,650,295 | B2 | 11/2003 | Ollikainen et al. | |
| 6,762,723 | B2 | 7/2004 | Nallo et al. | |
| 6,762,763 | B1 | 7/2004 | Migdal et al. | |
| 6,950,072 | B2 | 9/2005 | Miyata et al. | |
| 7,068,230 | B2 * | 6/2006 | Qi et al. | 343/702 |
| 7,136,020 | B2 | 11/2006 | Yamaki | |
| 7,196,667 | B2 | 3/2007 | Watada et al. | |
| 7,339,528 | B2 | 3/2008 | Wang et al. | |
| 7,403,161 | B2 | 7/2008 | DiNallo et al. | |
| 7,423,598 | B2 | 9/2008 | Bit-Babik et al. | |
| 7,605,764 | B2 * | 10/2009 | Ishimiya | 343/702 |
| 2004/0090373 | A1 | 5/2004 | Faraone et al. | |
| 2004/0169606 | A1 | 9/2004 | Sato et al. | |
| 2004/0252063 | A1 | 12/2004 | Sadamori et al. | |
| 2005/0024271 | A1 | 2/2005 | Ying et al. | |
| 2006/0244665 | A1 | 11/2006 | Tung | |
| 2007/0085747 | A1 | 4/2007 | DiNallo et al. | |
| 2008/0012774 | A1 * | 1/2008 | Wang | 343/702 |
| 2008/0100516 | A1 | 5/2008 | DiNallo et al. | |

FOREIGN PATENT DOCUMENTS

| | | | |
|---|---|---|---|
| GB | 2366916 | A | 3/2002 |
| WO | 8910012 | A1 | 10/1989 |
| WO | 9913528 | A1 | 3/1999 |
| WO | 2008063788 | A2 | 5/2008 |

* cited by examiner

*Primary Examiner* — Tan Ho

(57) ABSTRACT

A portable electronic device (100) having an antenna sub-assembly (204) including a conductor with a first portion (216) along a first surface of a circuit board, a second portion (218) connected to the first portion along an edge of the circuit board, and a third portion (220) connected to the second portion. The third portion is along a second surface of the circuit board. A feed leg (222) couples to the conductor to radio circuitry.

16 Claims, 5 Drawing Sheets

ANTENNA SUB-ASSEMBLY FOR ELECTRONIC DEVICE

FIELD OF THE DISCLOSURE

The present disclosure relates generally to electronic devices and more specifically to antenna sub-assemblies for electronic device and combinations thereof.

BACKGROUND

Portable electronic devices having radio reception or radio communication capabilities typically include one or more antenna sub-assemblies. Examples of such devices include, but are not limited to, mobile phones, pagers, radio sets, Personal Digital Assistant (PDA) and gaming devices capable of radio communications, satellite navigation devices and television receivers. Antennas subassemblies suitable for these portable device applications include, but are not limited to, Folded Inverted Conformal Antenna (FICA) sub-assemblies, Planar Inverted-F Antenna (PIFA) sub-assemblies, an Inverted-F Antenna (IFA) sub-assemblies, a Folded-J Antenna (FJA) sub-assemblies, a monopole antenna sub-assemblies, and a loop antenna sub-assemblies.

The size of the antenna sub-assembly in portable electronic device, for example, in a mobile phone, constrains the overall size of the device. For example, a FJA sub-assembly used in a candy bar mobile phone and a clam shell mobile phone requires around 13 millimeters (mm) of ground-keep-out area. Similarly, a FICA sub-assembly for some cellular mobile phone applications requires two elongated U-shaped conductors, around 15-20 mm long, depending on the operating frequency. Moreover, some FICA sub-assemblies require clearance distance from certain metallic components, for example, the battery and keypad, to avoid interference. It is challenging to reduce antenna size without sacrificing antenna performance.

The various aspects, features and advantages of the disclosure will become more fully apparent to those having ordinary skill in the art upon careful consideration of the following Detailed Description and the accompanying drawings described below. The drawings may have been simplified for clarity and are not necessarily drawn to scale.

DETAILED DESCRIPTION

Various embodiments of the present disclosure provide an electronic device having an antenna sub-assembly. The antenna sub-assembly includes at least one conductor and a feed leg. The at least one conductor has a first portion along a first side of a surface. In one application, the surface corresponds to a printed circuit board. The at least one conductor also includes a second portion connected to the first portion. The second portion is along an edge of the surface. Further, the at least one conductor has a third portion connected to the second portion. The third portion is along a second side of the surface. The at least one conductor is coupled to the feed leg of the antenna sub-assembly.

One embodiment provides a portable electronic device. The device includes a circuit board and an antenna sub-assembly. The circuit board has a first surface, a second surface, and at least one edge. The second surface is substantially parallel to the first surface and the at least one edge extends between the first and second surfaces. The antenna sub-assembly, coupled to the circuit board, includes at least one conductor. The at least one conductor has a first portion along the first surface and a second portion connected to the first portion. The second portion is along the at least one edge. The at least one conductor also has a third portion connected to the second portion. The third portion is along the second surface.

Another embodiment provides an electronic device having a Folded Inverted Conformal Antenna (FICA) sub-assembly. The FICA sub-assembly includes at least one conductor and a feed leg. The at least one conductor includes a first portion along a first side of a surface. The surface corresponds to a circuit board that provides circuitry for the electronic device. The at least one conductor has a second portion. The second portion is connected to the first portion. The second portion is along an edge of the surface and is substantially perpendicular to the first portion. The at least one conductor also has a third portion connected to the second portion. The third portion is along a second side of the surface, and is substantially parallel to the first portion. The feed leg of the FICA sub-assembly is coupled to the at least one conductor. The feed leg is used to activate the FICA sub-assembly.

Figure 1:
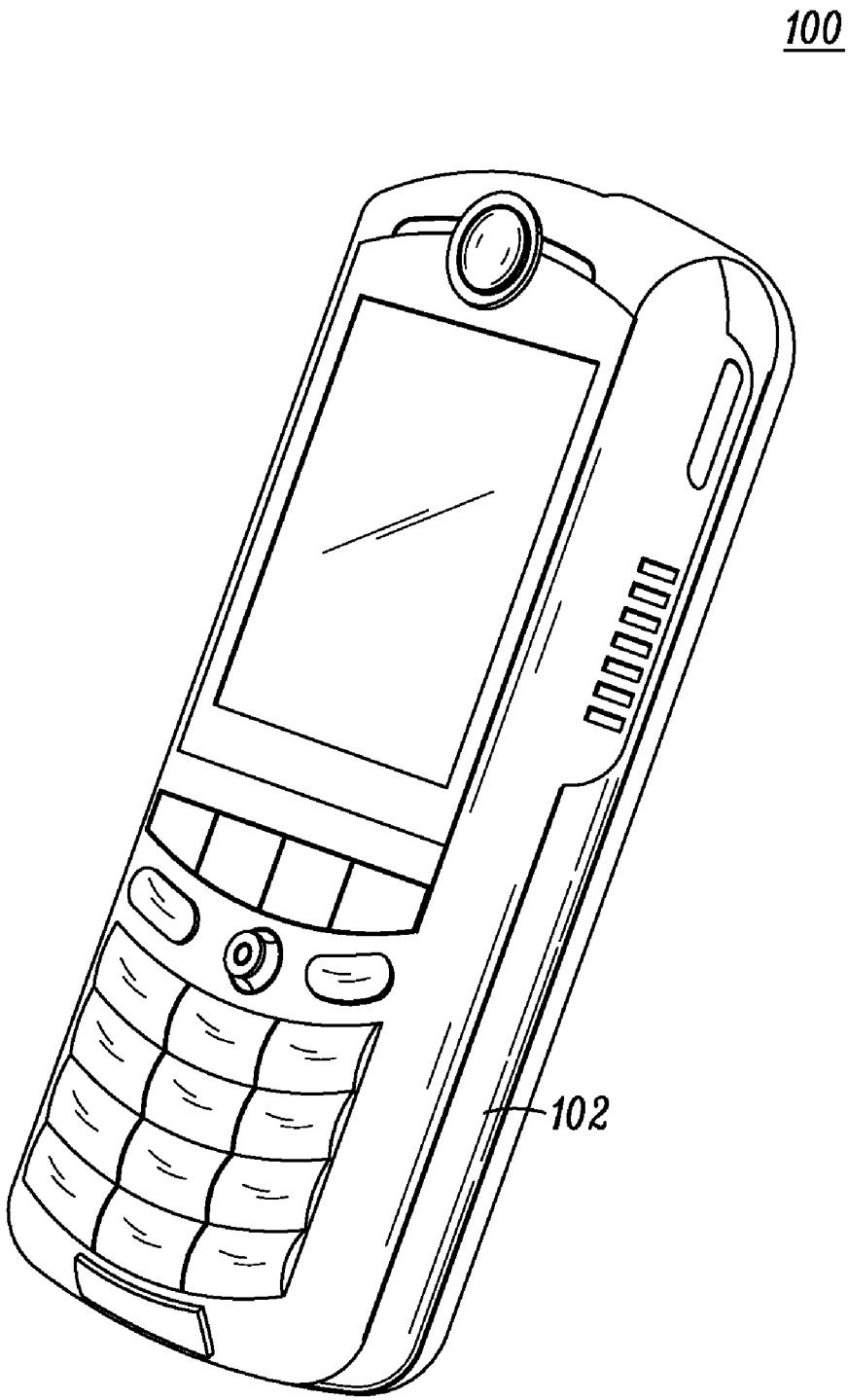
FIG. 1 illustrates an electronic device.

FIG. 1 illustrates a portable electronic device 100 embodied as a candy bar mobile phone. In other embodiments, the electronic device 100 may be embodied in a housing having a sliding element, or a clam-shell housing, or a housing having a rotating element. Examples of portable electronic devices include, but are not limited to, mobile cellular or satellite phones, pagers, radio communication devices, including Personal Digital Assistant (PDA) and gaming devices, satellite-based navigation devices and media signal receiving devices, for example, devices having an FM or XM radio or DVB-H receiver. The electronic device 100 includes a housing 102 that envelops other components of the electronic device 100 such as an antenna sub-assembly, a battery and a circuitry, for example, a radio receiver or transmitter, not shown but well known to those of ordinary skill in the art.

Figure 2:
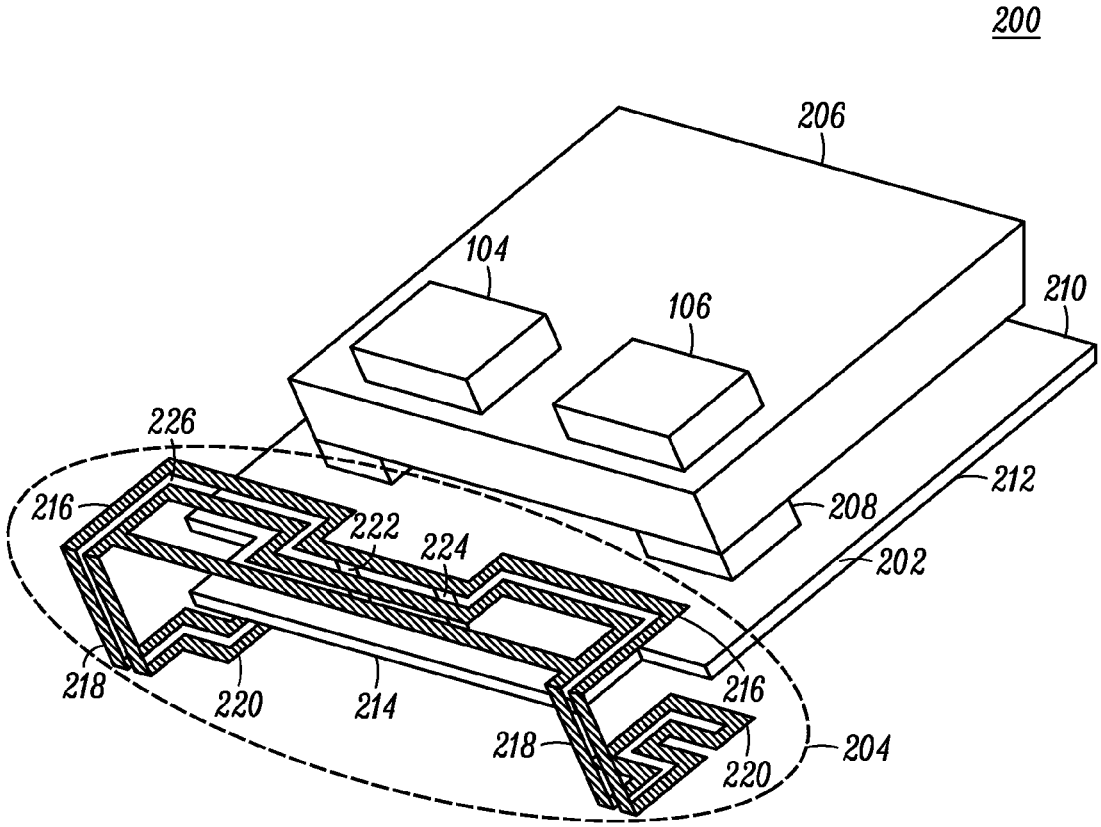
FIG. 2 is a partial view of an electronic device.

FIG. 2 illustrates a partial view of an electronic device 100 including a circuit board 202, an antenna sub-assembly 204, a battery 206, and a support 208. The circuit board 202 has two surfaces on opposite sides, a first surface 210 and a second surface 212. Typically, the first surface 210 is a top surface of the circuit board 202 and the second surface 212 is the bottom surface of the circuit board 202, but the first surface could be bottom and the second could be the top.

Figure 3:
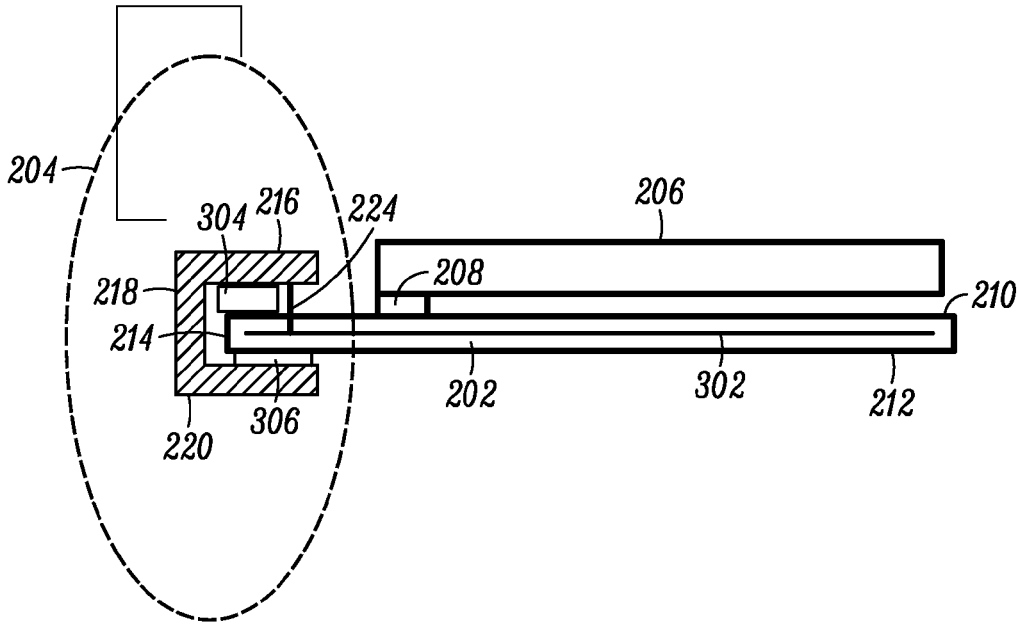
FIG. 3 illustrates a sectional side-view of an electronic device.

The second surface 212 is substantially parallel to the first surface 210. The circuit board 202 has an edge 214 associated with the first surface 210 and the second surface 212. The edge 214 extends between the first and second opposite sides of surfaces of the circuit board. In FIG. 2, the edge 214 defines the perimeter of the circuit board 202 comprising opposite ends and opposite sides. In FIGS. 2 and 3, the antenna sub-assembly 204 is disposed proximate an end of the circuit board.

The circuit board 202 provides circuitry for the electronic device and supports a plurality of components including radio circuitry 104. The radio circuitry may include, but is not limited to, a receiver and/or transmitter used for voice and/or data communications or for receiving satellite navigation signals. The circuit board typically includes other circuitry, for example, a controller 106 in the form of a DSP and/or a processor, memory, user interface circuits and devices some of which are not illustrated. The particular circuits and other elements of the circuit board are generally dependent on the type of portable electronic device with which the circuit board is associated, as is known generally by those of ordinary skill in the art.

In FIG. 2, the electronic device 100 includes the antenna sub-assembly 204. Examples of the antenna sub-assembly 204 include, but are not limited to, a Folded Inverted Conformal Antenna (FICA) sub-assembly, a Planar Inverted-F Antenna (PIFA) sub-assembly, an Inverted-F Antenna (IFA) sub-assembly, a Folded-J Antenna (FJA) sub-assembly, a monopole antenna sub-assembly, and a loop antenna sub-assembly.

In FIG. 2, the antenna sub-assembly 204 includes at least one conductor and a feed leg (not shown in FIG. 2). The at least one conductor includes a first portion 216, a second portion 218, and a third portion 220. In an embodiment, the first portion 216 is along a first side of the surface. The first portion 216 has a serpentine pattern. The first portion 216 is disposed along the top surface of the circuit board 202. The first portion 216 of the antenna is also separated from the circuit board 202 by a distance, although a portion of the antenna may be electrically coupled to the circuit board as discussed further below.

In FIG. 2, the first portion 216 is connected to the second portion 218. The second portion 218 extends along the edge between the first and second surfaces of the circuit board. The second portion of the antenna is spaced apart from the edge of the circuit board or at least does not contact a conductive portion of the circuit board. In FIG. 2, the second portion 218 of the antenna includes portions extending from opposite ends of the first portion 216 of the antenna. The second portions 218 are also spaced apart from the edge 214 of the circuit board.

The second portion 218 of the antenna is connected to the third portion 220. The third portion 220 is disposed along a second side of the circuit board, opposite the first side of the circuit board on which the first portion 216 of the antenna is located. In FIG. 2, the third portion 220 includes corresponding portions extending from the corresponding second portion 218. The third portions 220 also have a serpentine shape, which increases the electrical length thereof. The third portion 220 is along the bottom surface of the circuit board 202. In one embodiment, the second portions 218 are substantially perpendicular to the first portion 216. In FIG. 2, the third portions 220 of the antenna are substantially parallel to the first portion 216 thereof. Thus configured, the antenna sub-assembly 204 reduces the space required by wrapping the at least one conductor about a portion of the circuit board. In FIG. 3, the first portion 216 is shown to be substantially parallel to the first surface 210, the second portion 218 is shown to be along the at least one edge 214, and the third portion 220 is shown to be substantially parallel to the second surface 212.

In one embodiment, the at least one conductor has a slot. In FIG. 2, the at least one conductor is shown to have a single slot 226. In other embodiments, the at least one conductor can have multiple slots. The slot 226 extends through a substantial portion of the at least one conductor, for example, through one or more of the first, second and third portions of the at least one conductor, as discussed further below in conjunction with FIGS. 5 and 6. Typically, for a FICA sub-assembly, the width of the slot is less than 5 millimeters (mm). In implementation, the slot has a constant width, though it may have a variable width in other embodiments.

In FIG. 3, the circuit board 202 includes multiple layers. Typically, a ground surface 302 is included as a single layer from amongst the plurality of layers of the circuit board 202. In FIG. 3, the ground surface 302 is planar, but in other embodiments it may have a non-planar configuration. In yet another embodiment, the ground surface 302 includes several connected layers of the plurality of layers of the circuit board 202. In one embodiment, the antenna is grounded to the ground surface 302. In FIG. 3, a ground leg 224 electrically couples the at least one conductor, and particularly the first portion 216 thereof, to the ground surface 302. In other embodiments, other portions of the antenna may be coupled to the ground surface 302.

FIG. 3 illustrates a sectional side-view of the electronic device 100 having a ground surface 302, a first dielectric 304, a second dielectric 306, and other components shown and described in FIG. 2. The dielectrics generally insulate the antenna from conductive elements, and in some embodiments, the dielectrics provide structural support. In FIG. 3, for example, the first dielectric 304 insulates the first portion 216 of the antenna from the circuit board. The second dielectric 306 insulates the second portion 218 of the antenna. The shapes of the first and second dielectrics are dependent generally on the shapes of the corresponding first and second portions of the antenna and the proximity of other elements from which the antenna portions are insulated. In embodiments in which the one or more dielectrics provide support for the antenna, the feed leg and/or the ground leg, the shape or configuration of the dielectric may be dictated by the support requirement.

In FIGS. 2 and 3, the electronic device 100 includes a battery 206 coupled to the circuit board 202. The battery 206 provides electric power for the functioning of the electronic device 100. In some embodiments, the battery 206 is supported by a support member on the circuit board, for example, support 208 in FIGS. 2 and 3. The antenna sub-assembly 204 is typically separated from the battery 206 and circuit board by a finite distance to reduce interference. In FIG. 3, the first portion 216 of the antenna is separated from the first surface 210 by a second finite distance, the second portion 218 is separated from the at least one edge 214 by a third finite distance, and the third portion 220 is separated from the second surface 212 by a fourth finite distance. The antenna sub-assembly 204 is also separated from the battery 206.

An antenna feed leg electrically connects the at least one conductor to the circuit board. The feed leg is used to activate or drive the antenna sub-assembly 204. In FIGS. 2 and 3, one or more feed legs 224 connect the first portion 216 of the antenna to a conductor on the circuit board. In some embodiments, the antenna sub-assembly 204 also includes a ground leg, not shown in FIG. 2. The ground leg is coupled to the at least one conductor and provides a conductive path for grounding.

Figure 4:
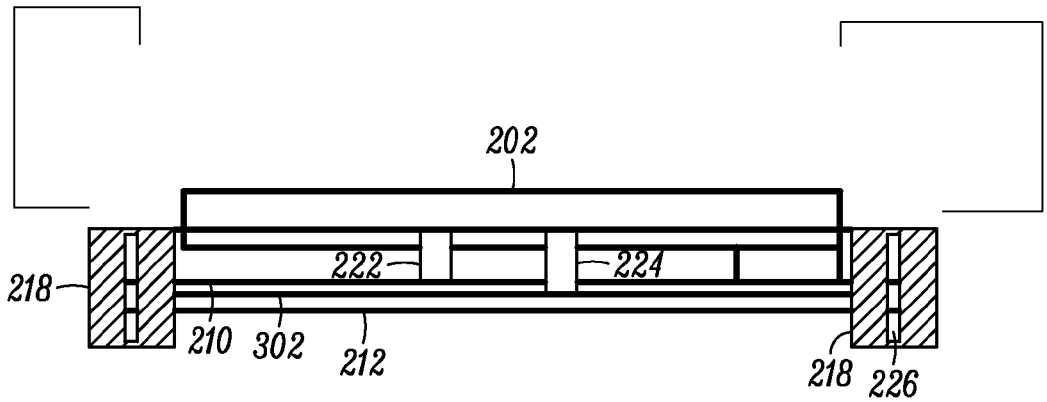
FIG. 4 illustrates a front-end view of an electronic device.

FIG. 4 illustrates the locations of the feed leg 222 and the ground leg 224. The ground leg 224 is shown to be connected to the ground surface 302. In some embodiments, the feed leg 222 and the ground leg 224 are located symmetrically with respect to the first portion 216. In other embodiments, the feed and ground legs are located asymmetrically with respect to the first portion 216. Also, the distance between the feed and ground legs may be adjusted to match impedance. As the feed leg and the ground leg are brought closer, the bandwidth of the operating band of the antenna sub-assembly 204 decreases. Increasing the distance between the feed leg 222 and the ground leg 224 increases the impedance of the antenna sub-assembly 204.

Figure 5:
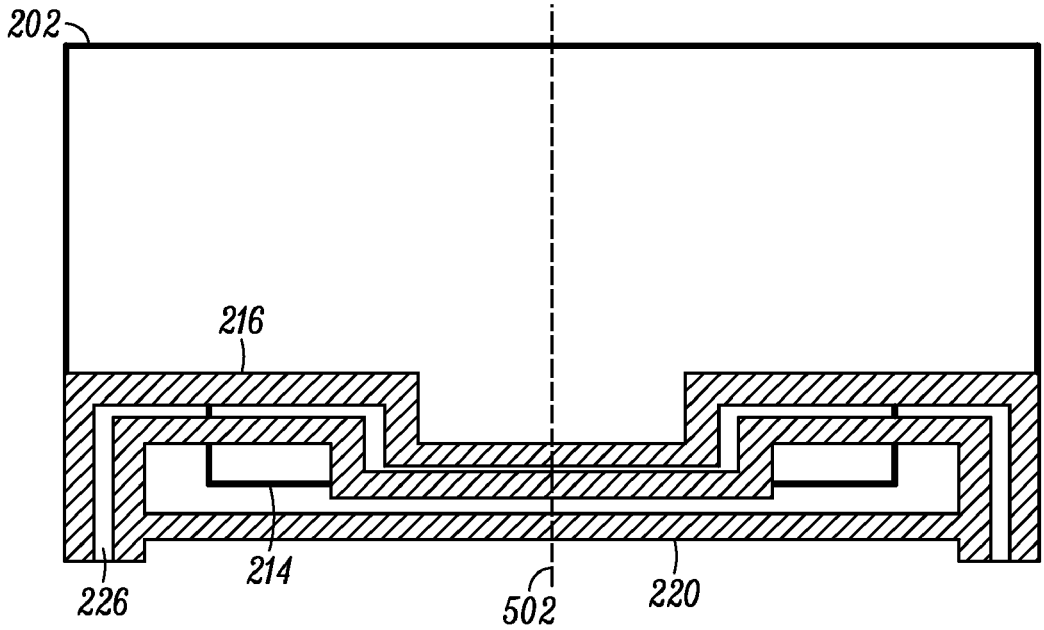
FIG. 5 illustrates a partial top-view of an electronic device.

FIG. 5 illustrates a partial top-view of the antenna sub-assembly 204. The sectional top-view of the electronic device 100 shows, the circuit board 202, the first portion 216, the third portion 220, the slot 226, and an plane of symmetry 502 of the at least one conductor that divides the at least one conductor into two substantially symmetrical parts.

The illustrated antenna sub-assembly is capable of operating in a common electromagnetic mode, a differential electromagnetic mode, and a slot electromagnetic mode. In the common electromagnetic mode, the electric field vectors extend between the at least one conductor and the ground surface. In this mode, the electric field is substantially symmetric about the plane of symmetry 502, illustrated in FIG. 5. In the common electromagnetic mode, the electric field vectors between different parts of the at least one conductor and the ground surface point in the same direction at any given instance of time. The same direction can be either toward the ground surface 302 or away from the ground surface. In common electromagnetic mode, the electric field vectors corresponding to the current flowing in the ground surface are oriented parallel to the plane of symmetry.

In the differential electromagnetic mode, the electric field is substantially anti-symmetric about the plane of symmetry 502, illustrated in FIG. 5. For example, at an instance of time, the electric field points toward the ground surface 302 on a first side of the plane of symmetry 502, and towards the at least one conductor on the second side of the plane of symmetry 502. In some embodiment, the at least one conductor may not exhibit bilateral symmetry. In this embodiment, when operating in the differential electromagnetic mode, there is a first point along the length of the first portion 216, and a second point along the length of the third portion 220. In this embodiment, on one side of the first point and the second point, the electric field points in one direction. For example, towards the at least one conductor from the ground surface 302. On an opposite side of the first point and the second point, the electric field points in the opposite direction. For example, towards the ground surface 302 from the at least one conductor. The antenna sub-assembly 204, as illustrated in FIG. 5, has the first point and the second point coincident with or close to the points at which the plane of symmetry 502 crosses the first portion 216 and the third portion 220.

In the slot electromagnetic mode, a strong electric field crosses the slot 226, and the electric field is substantially symmetric about the plane of symmetry 502.

Typically, the common electromagnetic mode, the differential electromagnetic mode, and the slot electromagnetic mode correspond to three frequency bands that can support communication at different communication channels. Each of the communication channels may use a different communication protocol. Examples of the protocol include Global System for Mobile Communications (GSM)-900, GSM-1800, GSM-1900, Advanced Mobile Phone System (AMPS), Universal Mobile Telecommunications System (UMTS) and the like. Typically, transmitters and receivers of the electronic device 100 operate at frequencies in bands associated with each of the three modes.

Typically, the slot 226 runs through the length of the at least one conductor. In one embodiment, the slot 226 follows a path characterized by a length that exceeds the length of the at least one conductor. In FIG. 5, the slot 226 corresponding to the first portion 216 is shown to be taking six right angle turns along the length of the first portion 216.

Figure 6:
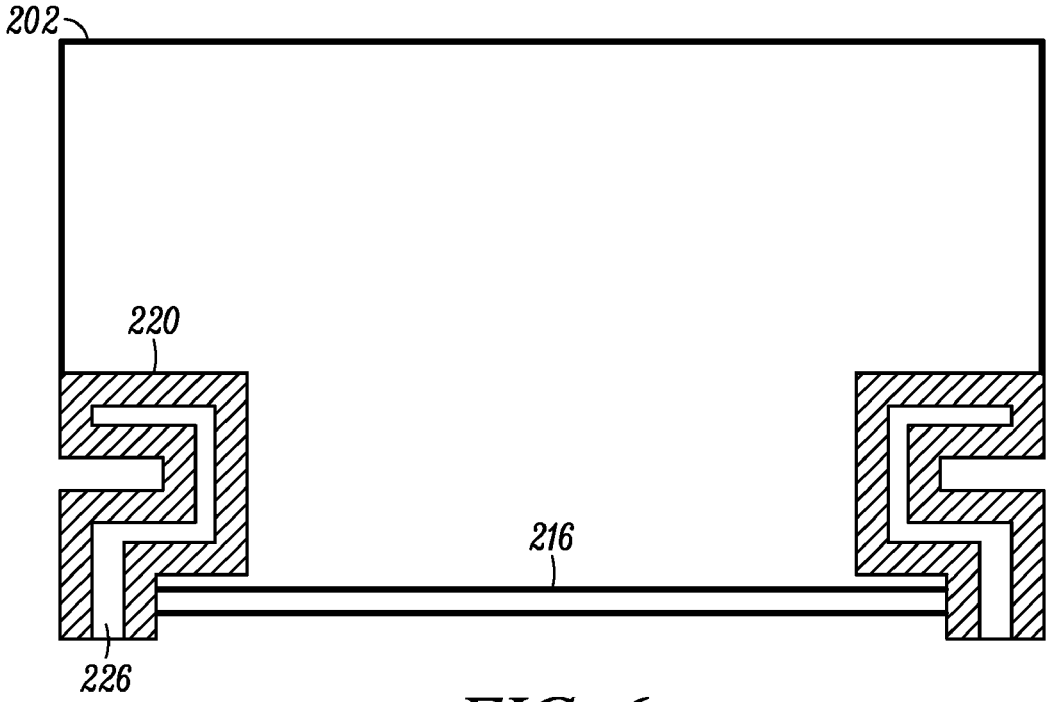
FIG. 6 illustrates a partial bottom-view of an electronic device.

FIG. 6 illustrates a sectional bottom-view of the electronic device 100 in accordance with an embodiment. The sectional bottom-view of the electronic device 100 shows, the circuit board 202, the first portion 216, the third portion 220, and the slot 226 corresponding to the third portion 220. The least one slot 226 corresponding to the third portion 220 is shown to be taking six right angle turns along the length of the third portion 220.

Figure 7:
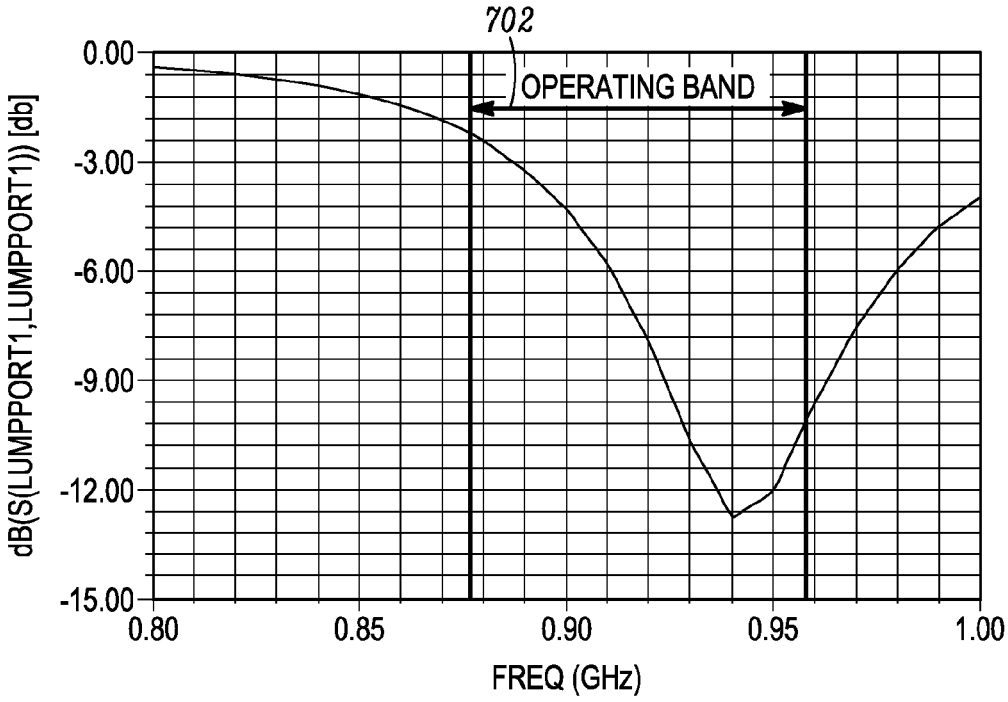
FIG. 7 illustrates an experimental first return loss plot for an antenna sub-assembly.

FIG. 7 illustrates an experimental first return loss plot 700 for the antenna sub-assembly 204, in accordance with one implementation. Return-loss is the power returned from an antenna sub-assembly. Typically, for a good antenna sub-assembly, the return loss is reduced. The X-axis shows the variation of the frequency (in Gigahertz (GHz)) and Y-axis shows the variation of power (in Decibel (Db)).

The first return loss plot shows the return loss of the antenna sub-assembly, determined over a frequency range of 800 Megahertz (MHz) to 1000 MHz. The first return loss plot shows a first operating band 702, extending from 878 MHz to 958 MHz, having a resonance frequency, centered approximately at 940 MHz. This first operating band 702 corresponds to the common electromagnetic mode. The first operating band 702 can, for example be used for GSM in the 900 MHz band.

Figure 8:
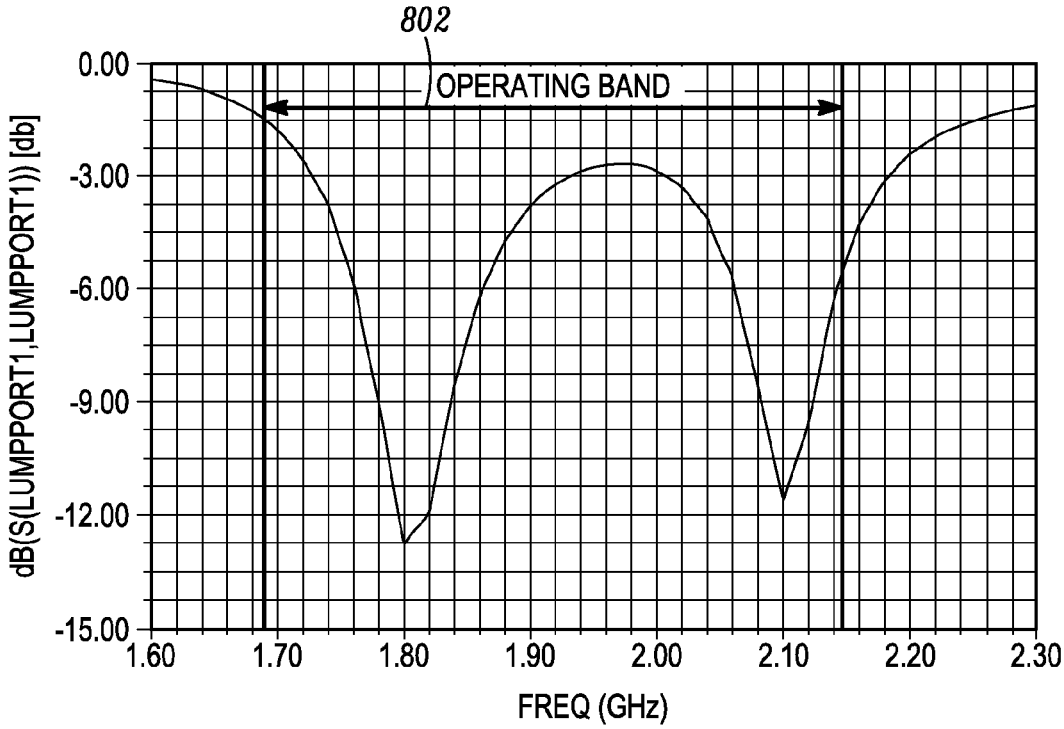
FIG. 8 illustrates an experimental second return loss plot for the antenna sub-assembly in accordance with an embodiment.

FIG. 8 illustrates an experimental second return loss plot 800 for the antenna sub-assembly 204, in accordance with an embodiment. The X-axis shows the variation of the frequency (in GHz) and Y-axis shows the variation of power (in Db). The second return loss plot shows the return loss of the antenna sub-assembly, determined over a frequency range of 1600 MHz to 2300 MHz.

The experimental second return loss plot 800 shows a second operating band 802, extending from 1690 MHz to 2150 MHz, having two resonance frequencies, centered approximately at 1800 MHz and 2100 MHz. The resonance frequency, centered approximately at 1800 MHz corresponds to the differential electromagnetic mode. The resonance frequency, centered approximately at 2100 MHz corresponds to the slot electromagnetic mode. The second operating band can be used for GSM, and UMTS communication. Hence, a multi-band performance is observed from the antenna sub-assembly 204, as shown in FIG. 7 and FIG. 8.

Various embodiments of the disclosure provide a compact antenna sub-assembly for an electronic device. The antenna sub-assembly reduces the space required by wrapping the at least one conductor around the circuit board of the electronic device. Moreover, the performance of the antenna sub-assembly remains approximately same. This enables the electronic device to have a compact size as well.

It is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

While the present disclosure and the best modes thereof have been described in a manner establishing possession and enabling those of ordinary skill to make and use the same, it will be understood and appreciated that there are equivalents to the exemplary embodiments disclosed herein and that modifications and variations may be made thereto without departing from the scope and spirit of the inventions, which are to be limited not by the exemplary embodiments but by the appended claims.

What is claimed is:

1. A portable electronic device comprising:

radio circuitry disposed on a circuit board, the circuit board having first and second surface on opposite sides of the circuit board and an edge extending between the first and second surfaces;

an antenna sub-assembly including a conductor coupled to the radio circuitry by a feed leg coupled, the conductor including a first portion disposed along the first surface of the circuit board, a third portion disposed along the second surface of the circuit board, and a second portion disposed along the edge of the circuit board, wherein the second portion is connected to the first portion, and the second portion portion of the conductor is spaced apart from the edge of the circuit board such that the second portion remains apart from a conductive portion of the circuit board.

2. The device of claim 1, the first portion includes opposite ends, the second portion includes first and second portions extending from the opposite ends of the first portion and disposed along the edge of the circuit board, the third portion includes first and second portions coupled to a corresponding one of the first and second portions extending from the opposite ends of the first portion.

3. The device of claim 2, the first and third portions have a serpentine shape.

4. The device of claim 1, wherein the second portion is substantially perpendicular to the first portion.

5. The device of claim 1, wherein the third portion is substantially parallel to the first portion.

6. The device of claim 1 further comprising a ground leg grounding the conductor to a ground on the circuit board.

7. The device of claim 1, the antenna sub-assembly is selected from a group comprising: a Folded Inverted Conformal Antenna (FICA) sub-assembly; a Planar Inverted-F Antenna (PIFA) sub-assembly; an Inverted-F Antenna (IFA) sub-assembly; a Folded-J Antenna (FJA) sub-assembly; a monopole antenna sub-assembly; and a loop antenna sub-assembly.

8. The device of claim 1, the conductor including a slot through a portion thereof.

9. An electronic device comprising:

a circuit board comprising a first surface, a second surface, and at least one edge, the second surface is substantially parallel to the first surface, the at least one edge extending between the first surface and the second surface; and an antenna sub-assembly electrically coupled to the circuit board, the antenna sub-assembly comprising a radiating conductor element wrapped about the first and second surfaces of the circuit board, wherein at least one portion of the antenna sub-assembly extends along the at least one edge of the circuit board, while configured to be spaced apart from the same edge of the circuit board such that the at least one portion of the antenna sub-assembly remains apart from a conductive portion of the circuit board.

10. The device of claim 9, the radiating conductor element including a first portion adjacent the first surface of the circuit board and a third portion adjacent the second surface of the circuit board, the first and third portions are substantially parallel.

11. The device of claim 10, the first and second portions have a serpentine shape.

12. The device of claim 9, the radiating conductor element including a second portion interconnecting the first and third portions, the second portion substantially perpendicular to the first and third portions.

13. The device of claim 9, the radiating conductor element including comprises at least one slot through a portion thereof.

14. The device of claim 9 further comprising a feed leg connecting the radiating conductor element to the circuit board.

15. The device of claim 9 further comprising a ground leg connected to the at least one conductor, wherein the ground leg provides a conductive path for grounding the at least one conductor.

16. The device of claim 9, the antenna sub-assembly is selected from a group comprising: a Folded Inverted Conformal Antenna (FICA) sub-assembly; a Planar Inverted-F Antenna (PIFA) sub-assembly; an Inverted-F Antenna (IFA) sub-assembly; a Folded-J Antenna (FJA) sub-assembly; a monopole antenna sub-assembly; and a loop antenna sub-assembly.

* * * * *